United States Patent [19]

Hickman

[11] 4,088,247

[45] May 9, 1978

[54] ENGINE STARTING AID

[75] Inventor: Ronald J. Hickman, Springfield, Ill.

[73] Assignee: Stewart-Warner Corporation, Chicago, Ill.

[21] Appl. No.: 634,664

[22] Filed: Nov. 24, 1975

[51] Int. Cl.[2] ..... F02M 1/16

[52] U.S. Cl. ..... 222/180; 123/32 AB; 222/504

[58] Field of Search ..... 222/504, 180, 325; 123/32 AB, 180 R, 187.5 R; 248/311.1, 311.3, 318

[56] References Cited

U.S. PATENT DOCUMENTS

| | | | |
|---|---|---|---|
| 3,189,014 | 6/1965 | Kus | 123/187.5 R |
| 3,416,507 | 12/1968 | Little | 123/180 R |
| 3,661,133 | 5/1972 | Rasch | 123/180 R |
| 3,913,537 | 10/1975 | Ziesche et al. | 123/32 AB |

*Primary Examiner*—Robert B. Reeves
*Assistant Examiner*—Fred A. Silverberg

[57] ABSTRACT

An engine starting aid consisting basically of a housing, a coil assembly and a bail assembly for holding a can to be dispensed to the housing, wherein the housing is formed integrally with an armature guide projecting through the coil assembly. The coil has bobbin flanges that are formed integrally with the armature guide and thus with the housing itself. The coil assembly includes a flux plate defining a portion of the flux path of the coil that serves an additional function of providing projecting flanges that define brackets for mounting the engine starting aid where desired. Also provided is a bail assembly that not only holds the can to be dispensed in position in the housing but also serves the additional function when positioned adjacent the housing of protecting the elements therein while in transit.

15 Claims, 11 Drawing Figures

ENGINE STARTING AID

BACKGROUND OF THE PRESENT INVENTION

The present invention relates to engine starting aids, for example of the type that electrically dispenses ether from a replaceable aerosol can. Such engine starting aids are shown in the A. J. Little U.S. Pat. No. 3,416,507 and the Rash U.S. Pat. No. 3,661,133 assigned to the assignee of the present invention. These prior devices, while completely satisfactory from a functional standpoint, were costly due to the method of assembly and the number of parts required for manufacture. Moreover, no provision was made in these prior devices for enclosing the housing during transit without the aerosol can.

It is a primary object of the present invention to provide a simplified and improved construction over those shown in the prior art.

SUMMARY OF THE PRESENT INVENTION

In accordance with the present invention, an engine starting aid is provided which may, for example, be an ether dispenser that dispenses fluid from an aerosol can, that is constructed of a fewer number of parts and is significantly simpler to manufacture. Firstly, the main housing is constructed entirely of plastic and the armature guide is formed integrally therewith. Flanges defining a spool for the coil assembly are formed integrally with the armature guide and thus form a one-piece construction with the main housing providing a less costly assembly than heretofore known in the prior art.

At one end of the coil assembly is a metal plate for directing the magnetic field of the coil assembly. This plate forms additional functions such as having flanges that define the mounting bracket for mounting the entire engine starting aid where desired.

A cup shaped shell covers the coil assembly and also defines a portion of the flux path for the coil, thus reducing the number of parts required in the assembly of the device.

A novel bail assembly is provided for urging the can upwardly into the main aperture in the main housing. According to the present invention, this bail assembly provides the additional function through the provision of multiple apertures in arms in the bail assembly of closing the main housing assembly aperture when no can is positioned therein during transit to protect the otherwise exposed parts within the assembly.

DETAILED DESCRIPTION OF THE PREFERRED EMBODIMENT

Figure 1:
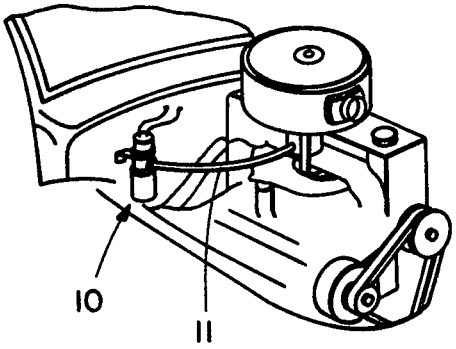
FIG. 1 is a fragmentary view of a vehicle having the present engine starting aid installed in position.

Referring to the drawings and particularly FIG. 1, an engine starting assist 10 according to the present invention is illustrated mounted on the firewall of a vehicle and connected through tube 11 to deliver fluid such as ether to the manifold of an engine during starting for the purpose of providing more reliable starts. The engine starting aid 10 is primarily designed to dispense starting liquid from a replaceable aerosol can containing a fluid such as ether.

The ether dispenser 10 consists basically of a main housing member 13, a coil assembly 14, a cup shaped metal shell 16 covering the coil assembly, a replaceable ether can 17 and a bail assembly 19 for holding the can 17 in position within the main housing member 13.

The housing 13 is generally cylindrical in construction and has a central lower aperture 20 annular in configuration for receiving aerosol can 17. Note that aerosol can 17 has a plunger nozzle 21 that when depressed propels fluid in an upward direction.

An annular seal member 22 mounted in housing recess 23 has a downward annular projection 24 for sealing the liquid ether from the atmosphere. Mounted within stepped counterbore 25 is a flanged bushing 26 having a lower interior shoulder 27 defining a spring seat for spring 29.

A plunger 31 is provided for the purpose of depressing the aerosol can plunger nozzle 21. Plunger 31 has a conical lower end 33 for fitting over the aerosol can plunger 21 and permitting fluid from the can to flow through interior passage 35 in the plunger 31. An integral flange 36 surrounds the plunger 31 and defines a spring seat for spring 29 urging the flange 36 to its uppermost position in abutment with an annular core member 38.

The core member 38 assists in strengthening the flux path to armature 40 in coil assembly 14.

Figure 5:
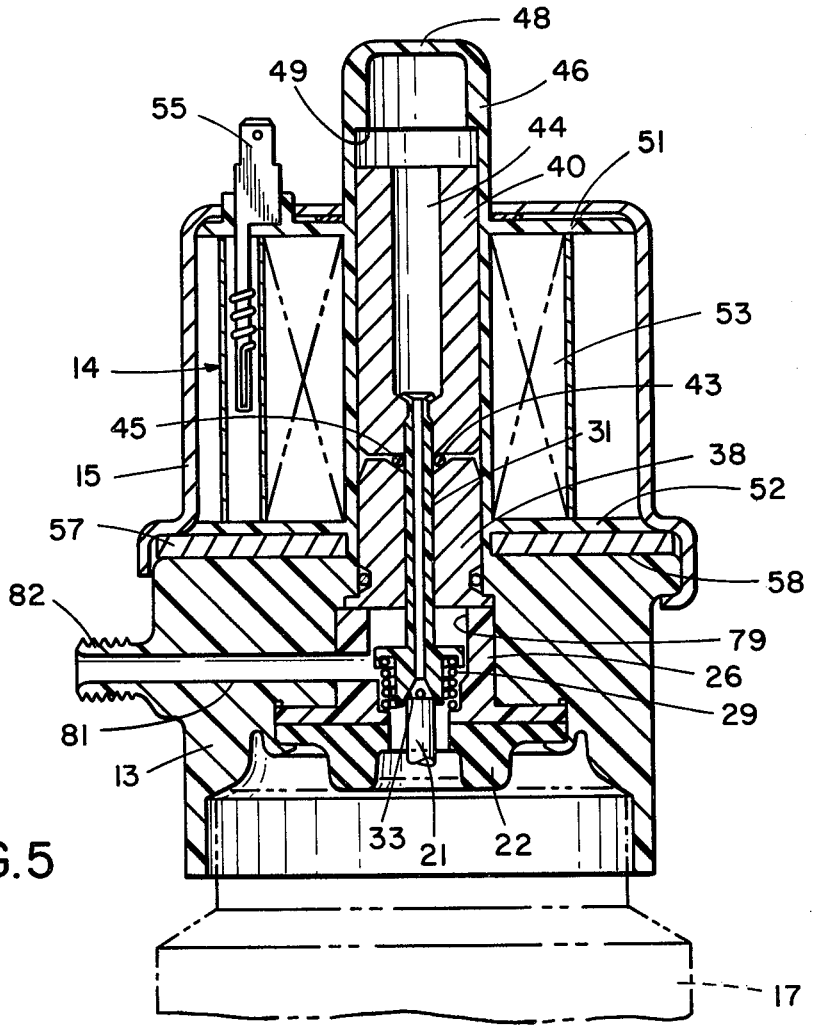
FIG. 5 is an enlarged longitudinal section similar to FIG. 4 except with the coil assembly energized.

The upper end of plunger 31 indicated at 41 is staked within a central opening 42 in the armature 40. An O-ring 43 surrounds plunger 31 at the lower end of the armature 40 for sealing chamber 44 by engagement with conical surface 45 on the upper surface of the core member 38 as seen clearly in FIG. 5.

An armature guide defined by annular portion 46 is integrally formed with the plastic housing 13. This guide has a closed upper end 48 and a shoulder 49 defining a stop for the upper movement of armature 40.

Figure 2:
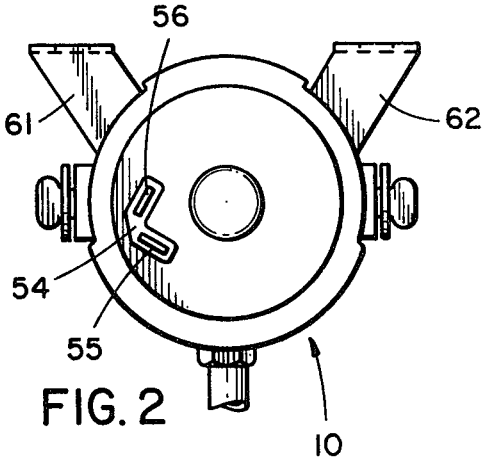
FIG. 2 is an enlarged top view of the present invention.
Figure 4:
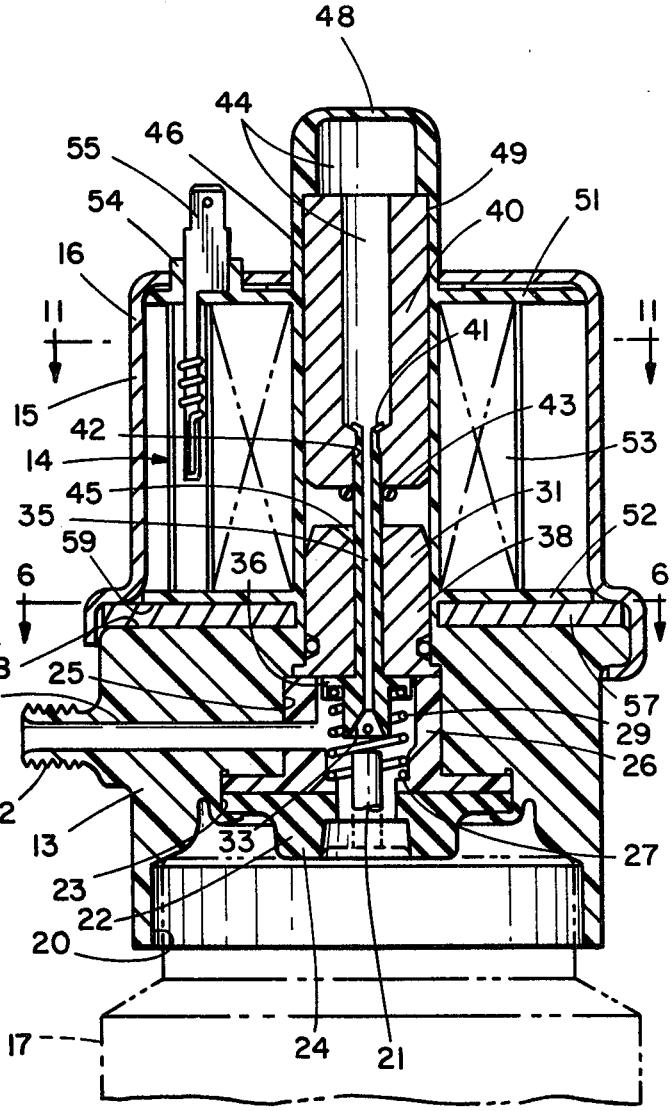
FIG. 4 is an enlarged longitudinal section of the present invention.

Formed integrally with the guide 46 are upper and lower annular flanges 51 and 52 that define a bobbin for coil 53 in the coil assembly 14. As seen in FIGS. 2 and 4, the upper flange 51 has integrally formed therewith a boss 54 for the terminals 55 and 56. The boss 54 projects upwardly through the metal cup shell 16 covering the coil assembly 14.

Figure 6:
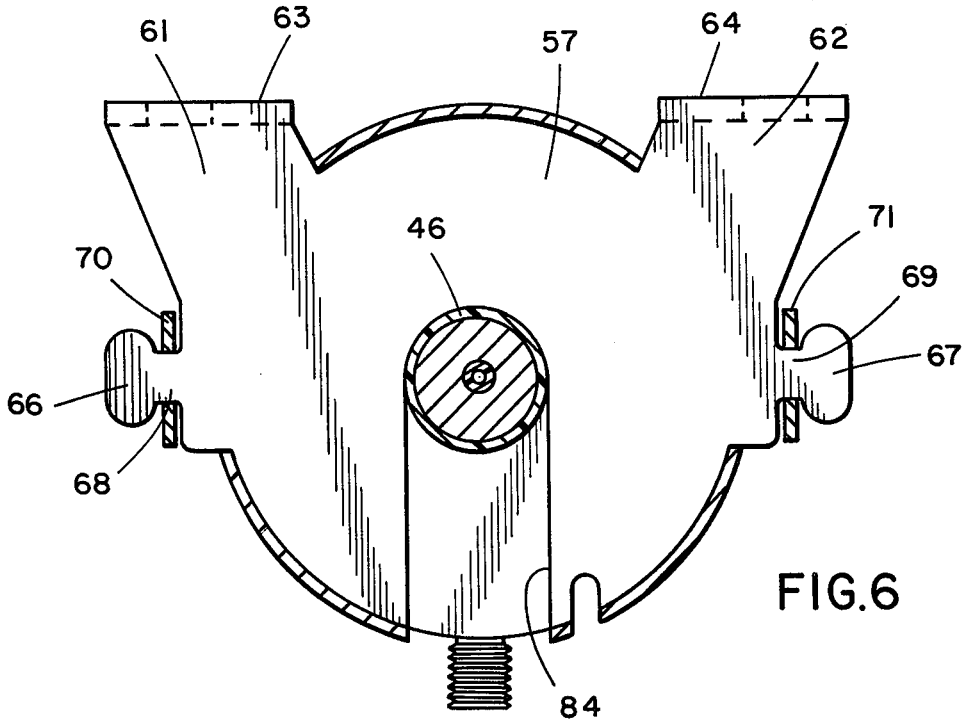
FIG. 6 is a cross-section taken generally along line 6—6 illustrating the mounting bracket.
Figure 7:
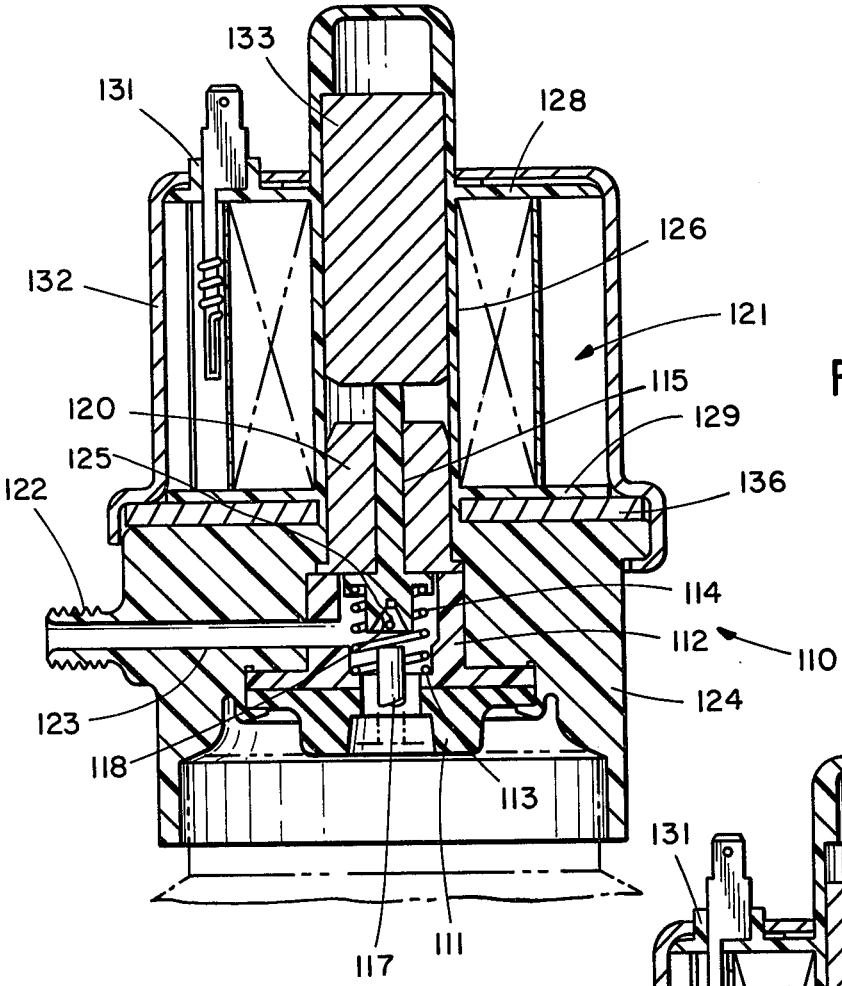
FIG. 7 is a longitudinal section of another embodiment of the present invention.
Figure 8:
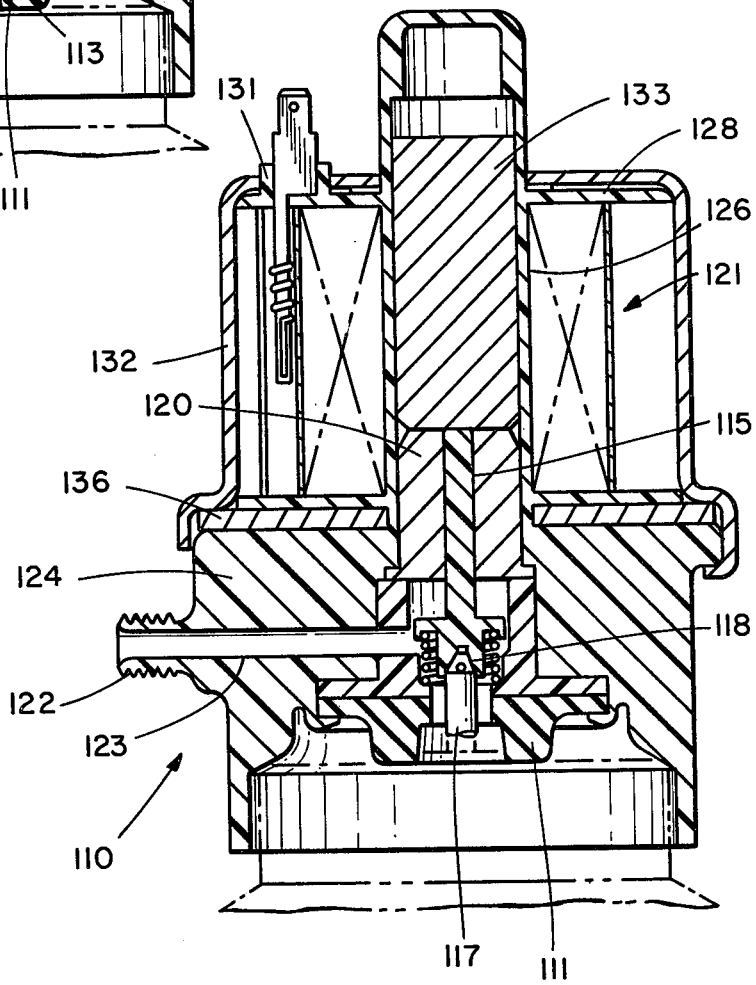
FIG. 8 is a longitudinal section similar to FIG. 7 except with the coil assembly energized.

A generally circular plate 57 is provided between upper surface 58 of housing 13 and lower surface 59 of the lower bobbin flange 52. Plate 57 serves a multiple function. Firstly, it defines a portion of the magnetic field path for the coil 53. Secondly, it defines the mounting bracket for the entire ether dispenser assembly 10. Toward this end and viewing FIGS. 2 and 6, the plate 57 has outwardly extending projections 61 and 62 with downwardly turned flanges 63 and 64 that have apertures therein for fastening the device 10 to any suitable surface. Moreover, as seen in FIG. 6, elongated ears 66 and 67 have reduced portions 68 and 69 that receive arms 70 and 71 of the bail assembly 19. The operation of the bail assembly 19 will be described in more detail with respect to the embodiment of FIGS. 7 to 10.

Referring to FIG. 6, it should be understood that the plate 57 has a radial slot as indicated at 84 for the purpose of permitting assembly around the armature guide 46.

Figure 3:
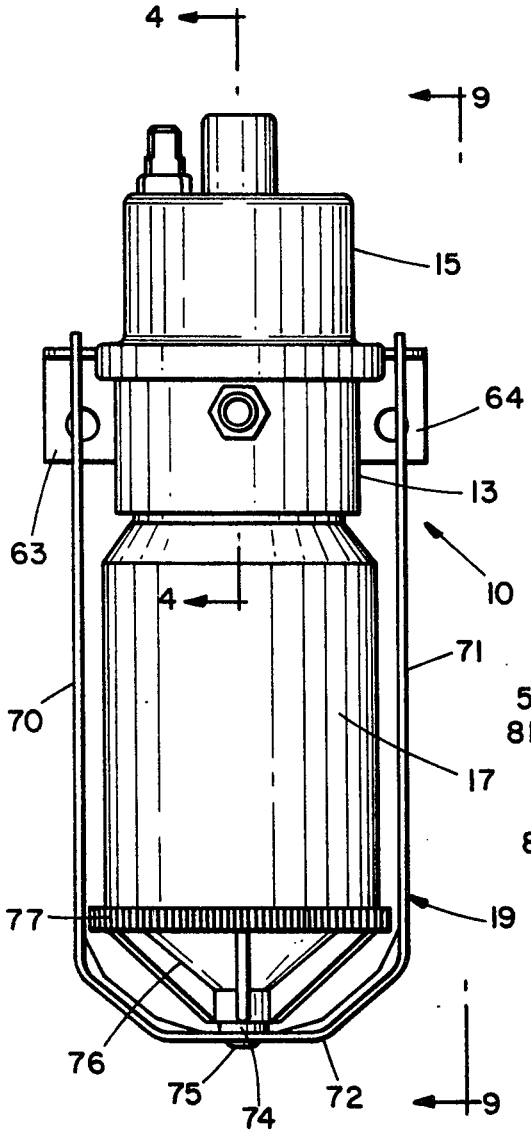
FIG. 3 is a front view of the ether dispenser assembly with the aerosol can in position.

Briefly, however, referring to FIG. 3, the bail assembly 19 includes a U-shaped bail 72 having a threaded member 74 staked as indicated at 75 to the bail 72 centrally at the bottom. Threaded on the fastener 74 is a cup shaped plastic member 76 that has an annular serrated rim 77 for the purpose of manual rotation to move the cup shaped member axially upwardly urging the can 17 into engagement with the annular flange 24 of the seal member 22 in annular opening 20 in the main housing 13.

In operation, when the coil 53 is energized, armature 40 is pulled in a downward direction until seal 43 engages conical surface 45 on the core member 38. As this occurs, conical portion 33 of 31 engages plunger 21 of the aerosol can releasing ether or other starting fluid into the chamber 44. The chamber 44 will continue filling until the pressure therein has a predetermined value with respect to the pressure within the can 17. This is illustrated by the position shown in FIG. 5. When the coil is deenergized, plunger 31 moves in a upward direction under the influence of spring 29 releasing fluid from chamber 44 into chamber 79 defined by bushing 26 and from there through radial passage 81 in the main housing 13 and out fitting 82 to the engine manifold. Because the pressure in chamber 44 has a predetermined relation to the pressure in can 17, the dispenser will deliver a predetermined amount of starting fluid to the engine upon each energization of coil 53. This is sometimes referred to in the art as a "measured shot" ether dispenser.

Referring to the second embodiment of the invention, and more particularly FIGS. 7 to 10, an ether dispenser or engine starting aid 110 is illustrated of generally similar construction to that shown in FIGS. 1 to 6. The difference between the two embodiments is that in the FIGS. 7 to 10 embodiment, fluid from the aerosol can will flow continuously to the engine so long as the coil assembly is energized.

As with the first embodiment, the embodiment of FIGS. 7 to 10 includes a sealing bushing 111, a flanged bushing 112 defining a spring seat 113 for spring 114 which acts on a plunger 115. Plunger 115 actuates aerosol plunger 117 by engagement with conical surface 118 on the plunger 115. Plunger 115 is slidable in core piece 120. The conical surface 118, however, has a slotted opening 125 which permits the escape of fluid from the conical recess during depression of the plunger 115 to the position shown in FIG. 8. Thus, so long as coil assembly 121 is energized, the flow will be continuous from plunger 117 to outlet fitting 122, through passage 123.

Formed integrally with housing member 124 is armature guide 126. In turn, coil assembly flanges 128 and 129 are formed integrally with the guideway 126 so that the flange 129, guide 126 and housing 124 are all formed in a single piece of plastic. Terminal boss 131 is formed integrally with upper flange 128 in a manner similar to the FIGS. 1 to 6 embodiment. Metal shell housing 132 covers the coil assembly 121 and also serves as a path for the magnetic field in the coil assembly 121 in the same manner as FIGS. 1 to 6 embodiment.

Armature 133 is slidable in the guide way 126. When armature 133 is actuated or moved downwardly under the influence of the coil assembly, plunger 115 moves downwardly depressing can plunger 117 and causing a continuous flow as described above through outlet fitting 122 until the coil assembly 121 is deenergized.

Flux plate 136 is provided which serves the same function as and is identical in construction to the flux plate 57 in the FIGS. 1 to 6 embodiment.

Figure 9:
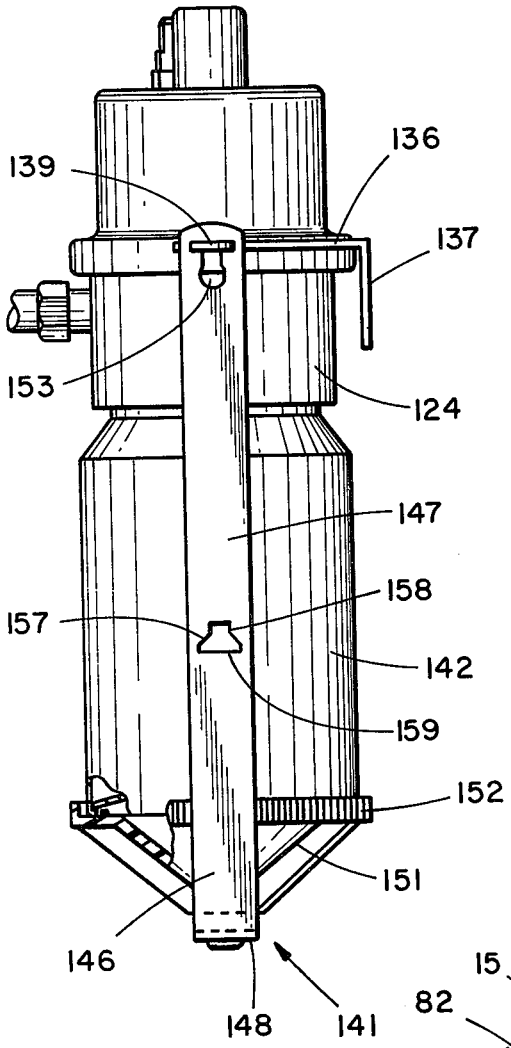
FIG. 9 is a side view of the present invention illustrating the bail assembly.

As shown in FIG. 9, the plate 136 has an integral mounting bracket 137 and spaced ears 139 identical to that shown in FIG. 6.

Figure 10:
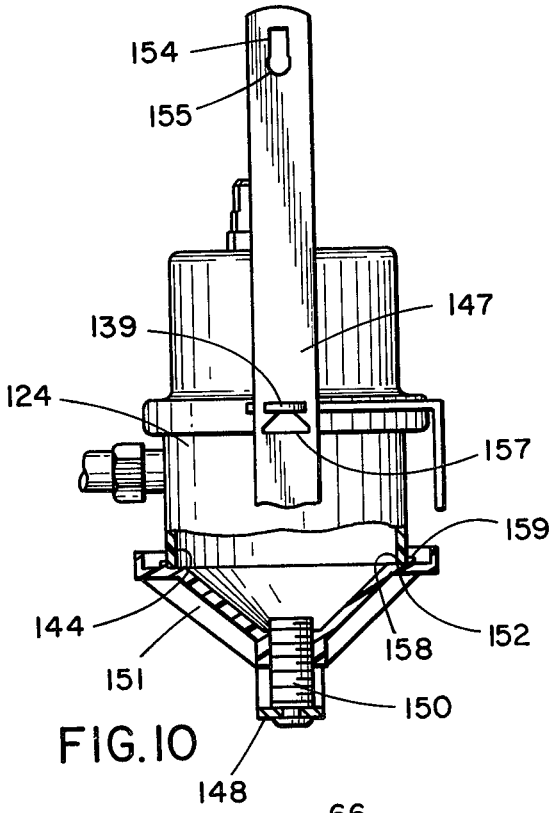
FIG. 10 is a side view of the present invention with the aerosol can removed and the bail assembly moved to its in-transit position.
Figure 11:
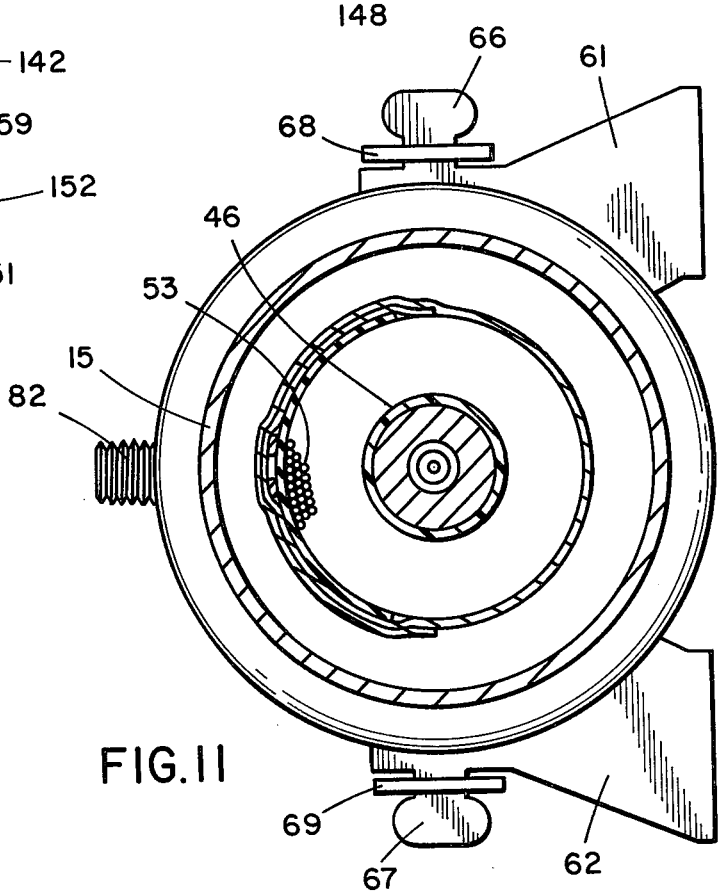
FIG. 11 is a cross-section taken generally along line 11—11 of FIG. 4.

As described above, bail assembly 141 provides the twofold function of urging can 142 up into the housing 114 and into engagement with seal 111 when in use and the secondary function, as shown in FIG. 10, of closing the open recess 144 in the housing 124 during shipment or transit. The bail assembly 141 is identical to the bail assembly 19 illustrated in FIGS. 1 through 6. Bail assembly 141 includes a U-shaped member 146 having arms 147 and a bite portion 148 staked to a vertical threaded fastener 150 as shown in FIG. 10. A cup shaped member 151 is threaded on fastener 150 for the purpose of providing vertical movement of the cup shaped member 151. The cup shaped member has an annular serrated portion 152 for the purpose of manually rotating the cup on fastener 150.

The arms 147 have upper slots 153 having straight upper portions 154 and enlarged arcuate lower portions 155. The upper openings 153 are employed when the can 142 is desired to be placed in position and this is done by rotating the arms 147 until the straight portion 154 is in alignment with the ears 139 at which time the arms are rotated downwardly to a vertical position on the threaded portion 152 rotated urging the can upwardly into its proper position.

Also provided is a second set of apertures 157 having straight upper portions 158 and enlarged triangular lower portions 159 having a width somewhat greater than that of the ears 139 so that they may be inserted thereover without rotation of the arms 147. As seen in FIG. 10, the arms 147 are first placed over the apertures 157 and thereafter the cup 151 is rotated until bottom edge 152 of the housing 124 comes into engagement with surface 158 on the cup 151. An annular shoulder 159 is provided on surface 158 for the purpose of providing a seal.

I claim:

1. An engine starting aid for dispensing fluid from a can, comprising; a generally annular housing member having an opening therein for receiving fluid from the can, an armature for actuating the can of fluid, a guide for said armature integral with said housing member, a plunger actuated by said armature, spaced flanges integral with the armature guide and defining a bobbin therewith, and a coil surrounding said bobbin for actuating said armature and said plunger, whereby the armature may be inserted into the housing opening during assembly.

2. An engine starting aid adapted to dispense fluid from a can, as defined in claim 1, including a lower pole piece in said armature guide for increasing the magnetic field.

3. An engine starting aid adapted to dispense fluid from a can as defined in claim 1, including a metal shell surrounding said bobbin and defining a portion of the magnetic field of the coil.

4. An engine starting aid adapted to dispense fluid from a can as defined in claim 3, wherein said shell is cup-shaped.

5. An engine starting aid adapted to dispense fluid from a can as defined in claim 1, wherein said guide is cylindrical and has an integral closed upper end.

6. An engine starting aid for dispensing fluid from a can, comprising; a generally annular housing member having an opening therein for receiving fluid from the can, an armature for actuating the can of fluid, a guide for said armature integral with said housing member, a plunger actuated by said armature, spaced flanges integral with the armature guide and defining a bobbin therewith, a coil surrounding said bobbin for actuating movement of said armature and said plunger, and a lower pole piece in said armature guide for concentrating the magnetic field and a metal shell surrounding said bobbin and defining a portion of the magnetic field of the coil.

7. An engine starting aid for dispensing fluid from a can, comprising; a generally annular housing member having an opening therein for receiving fluid from the can, an armature for actuating the can of fluid, a guide for said armature integral with said housing member, a plunger actuated by said armature, spaced flanges integral with the armature guide and defining a bobbin therewith, a coil surrounding said bobbin for actuating movement of said armature and said plunger, a lower pole piece in said armature guide for concentrating the magnetic field, and a metal shell surrounding said bobbin and defining a portion of the magnetic field path of the coil, said shell being cup-shaped, said guide being cylindrical and having an integral closed upper end.

8. An engine starting aid for dispensing fluid from a can, comprising; a housing, a plunger mounted in said housing for actuating the can, an aperture in said housing for receiving said can, a member positionable below the can for urging the can upwardly into the aperture in said housing, said member having a first position below the can when the starting aid is in normal use, said member having a second position engaging the housing and covering said aperture during transit.

9. An engine starting aid for dispensing fluid from a can as defined in claim 8, wherein said member is a cup and forms part of a bail assembly.

10. An engine starting aid for dispensing fluid from a can as defined in claim 9, wherein said housing has ears projecting therefrom, said bail assembly having two arms projecting upwardly from said cup, each of said arms having two spaced openings therein defining the two positions of the cup.

11. An engine starting aid for dispensing fluid from a can, comprising; a housing, a plunger mounted in said housing for actuating the can, an aperture in said housing for receiving said can, a member positionable below the can for urging the can upwardly into the aperture in said housing, said member having a first position below the can when the starting aid is in normal use, said member having a second position engaging the housing and covering said aperture during transit, said member being a cup and forming part of a bail assembly, said housing having ears projecting therefrom, said bail assembly having two arms projecting upwardly from said cup, each of said arms having two spaced openings therein defining the two positions of the cup.

12. An engine starting aid for dispensing fluid from a can, comprising; a generally annular housing member having an opening therein adapted to receive fluid from a can, an armature for actuating the can of fluid, a guide for said armature integral with said housing member, a plunger actuated by said armature, spaced flanges integral with the armature guide and defining a bobbin therewith, a coil surrounding said bobbin for actuating movement of said armature and said plunger, said coil including a plate defining a portion of the flux path of the coil, and bracket means for the entire assembly formed integrally with the plate, said bracket including right angle flanges extending rearwardly from and integral with said plate.

13. An engine starting aid for dispensing fluid from a can, comprising; a generally annular housing member having an opening therein for receiving fluid from the can, an armature for actuating the can of fluid, a guide for said armature integral with said housing member, a plunger actuated by said armature, spaced flanges integral with the armature guide and defining a bobbin therewith, and a coil surrounding said bobbin, for actuating movement of said armature and said plunger, a member positionable below the can for urging the can upwardly into the opening in said housing, said member having a first position below the can when the starting aid is in normal use, said member having a second position engaging the housing and covering said aperture during transit.

14. An engine starting aid for dispensing fluid from a can, comprising; a housing having an aperture therein for receiving the can containing fluid to be dispensed, a plunger mounted for movement in said housing to actuate the can for dispensing, an armature slidable in a guide for moving the plunger, a coil assembly surrounding the armature carried by said housing, said coil assembly including a plate defining a portion of the flux path of the coil assembly, bracket means for the entire assembly formed integrally with the plate, a member positionable below the can for urging the can upwardly into the aperture in said housing, said member having a first position below the can when the starting aid is in normal use, said member having a second position engaging the housing and covering said aperture during transit.

15. An engine starting aid for dispensing fluid from a can, comprising; a generally annular housing member having an opening therein adapted to receive fluid from the can, an armature for actuating the can of fluid, a guideway for said armature integral with said housing member, a plunger actuated by said armature, spaced flanges integral with the armature guide and defining a bobbin therewith, a coil surrounding said bobbin for actuating movement of said armature and said plunger, a lower pole piece in said armature guide for increasing the magnetic field, a metal shell surrounding said bobbin and defining a portion of the magnetic field of the coil, said shell being cup shaped, said guideway being cylindrical and having an integral closed upper end, a flux plate bracket including right angle flanges extending rearwardly from said plate, a bail assembly for supporting the can from the bottom, said bail assembly having two upwardly extending arms having openings therein, and ears formed integrally on said flux plate bracket and being received in said openings in said arms, said flux plate bracket having a radial slot permitting assembly of the flux plate around the armature guide.

* * * * *